US006046700A

United States Patent [19]

Kitchener et al.

[11] Patent Number: 6,046,700

[45] Date of Patent: Apr. 4, 2000

[54] ANTENNA ARRANGEMENT

[75] Inventors: Dean Kitchener, Brentwood; Martin Stevens Smith, Chelmsford; James Edward Joseph Dalley, North Weald, all of United Kingdom

[73] Assignee: Nortel Networks Corporation, Montreal, Canada

[21] Appl. No.: 08/864,197

[22] Filed: May 28, 1997

[30] Foreign Application Priority Data

Aug. 1, 1996 [GB] United Kingdom ..... 9616174

[51] Int. Cl.[7] ..... H01Q 21/00

[52] U.S. Cl. ..... 343/725; 343/702; 343/846

[58] Field of Search ..... 343/725, 702, 343/846, 848, 826, 828, 829, 803; H01Q 21/00

[56] References Cited

U.S. PATENT DOCUMENTS

| | | | |
|---|---|---|---|
| 4,864,320 | 9/1989 | Munson et al. | 343/829 |
| 5,157,410 | 10/1992 | Konishi | 343/715 |
| 5,248,988 | 9/1993 | Makino | 343/792 |
| 5,367,311 | 11/1994 | Egashira et al. | 343/749 |
| 5,517,676 | 5/1996 | Sekine et al. | 343/702 |
| 5,523,767 | 6/1996 | McCorkle | 343/846 |
| 5,757,333 | 5/1998 | Kitchener | 343/826 |
| 5,903,822 | 5/1999 | Sekine et al. | 343/702 |
| 5,936,583 | 8/1999 | Sekine et al. | 343/702 |

FOREIGN PATENT DOCUMENTS

WO 94/19873A1 of 0000 WIPO .

OTHER PUBLICATIONS

King, "Antennas And Waves: A Modern Approach", M.I.T. Press, 1969, p. 507.

*Primary Examiner*—Don Wong
*Assistant Examiner*—Hoang Nguyen
*Attorney, Agent, or Firm*—Lee, Mann, Smith, McWilliams, Sweeney & Ohlson

[57] ABSTRACT

A wireless subscriber terminal having an improved performance is disclosed. The terminal 12 comprises: a quarter wavelength monopole first antenna 14; a folded monopole second antenna; and a ground plane having a surface 18 angled with respect to the horizontal, wherein the ground plane has an axis a quarter of a wavelength long extending from a feed point for the first antenna and is electrically symmetrical about the axis. Mutual coupling effects between the first antenna and the second antenna are reduced. A method of operation is also disclosed.

15 Claims, 21 Drawing Sheets

ANTENNA ARRANGEMENT

FIELD OF THE INVENTION

This invention relates to an antenna arrangement and in particular to an antenna arrangement suitable for use in fixed radio access systems telecommunications.

BACKGROUND TO THE INVENTION

Fixed radio access systems are currently employed for receiving direct satellite television broadcasts from satellites and for local telecommunication networks. Known systems comprise an antenna—popularly known as a satellite dish—and decoding means. The antenna receives the signal and provides a further signal by wire to a decoding means. In the case of fixed radio access telecommunications, subscribers are connected to a telecommunications network by a radio link in place of the more traditional method of copper cable. The radio transceivers at the subscribers premises communicate with a base station, which provides cellular coverage over, typically, a 5 km radius in urban environments. Each base station is connected to the standard PSTN switch via a conventional transmission link/network.

The decoder for each fixed radio access subscriber system will decode the received signal and encode signals to be transmitted, whilst in the case of a satellite broadcast receiving arrangement, the decoder will provide demodulated signals for a television receiver. The distance between the antenna and the decoder can sometimes be many meters apart; this can lead to a degradation of the received signal and either they require a larger receiving antenna; a higher power decoder; or a higher quality connector between the antenna and decoder. In many instances the solutions can be overly expensive and/or result in large apparatus being employed.

At a subscribers premises, the subscriber will require for a wireless in the local loop application: a handset, decoding means and an antenna, and for a satellite application: a set-top unit/decoding means and an antenna. Frequently the decoding means is combined with the antenna or the telephone facsimile receiver in a wireless in the local loop telecommunications but many difficulties arise. One solution has been to provide an integrated terminal and antenna arrangement.

In the case of wireless in the local loops, planning regulations and frequency allocation means that many systems operate or are planned to operate in the 400–800 MHz region. The wavelength in these frequency bands are 60–30 cm and terminals will be required to be much smaller than these dimensions.

At 450 MHz, a typical operating frequency, a dipole antenna would need to be half a wavelength in length which is of the order of 30 cm with a quarter wavelength monopole being only half of that again. The dimensions of the box can be equivalent to that of the antenna. A second antenna element can also be used to give receive diversity. One constraint of an integrated antenna and telephone/decoder is that shielding of electronic circuitry is required and such shielding can adversely affect the performance of the antennas. The circuitry can be bulky but should be enclosed in a structure designed taking aesthetic considerations into account, which may affect the orientation of an antenna with respect to the shielding enclosure.

Presently some terminals sit flat on a desktop, but this can be a serious limitation, especially when antenna lengths can be up to 40 cm. Telrad of Israel presently produce such an example with their CET-10 model which possesses a fixed, vertically oriented half wavelength omnidirectional main antenna and a second diversity antenna which comprises an internally mounted printed circuit antenna. In addition to being designed to be operable on a desk or similar horizontal surface, the terminal should be operable whilst mounted on a wall or similar vertical surface, when the terminal body and monopole will both be vertical.

Another known wireless in the local loop arrangement is a desk top terminal manufactured by the Mitsubishi Corporation which possesses two omnidirectional antennas. These antennas are half wavelength monopoles which, together with matching networks are each some 25 cm in length. The antennas are vertically oriented in a spaced apart fashion on the terminal housing which encloses an associated earthed box which houses electrical control circuitry.

When the antennas are mounted as described, in the above two cases, the radiation pattern currents are not optimised whereby an uncontrolled azimuth pattern is obtained which is of mixed polarisation resulting in nulls in the azimuth plane.

OBJECT OF THE INVENTION

The present invention seeks to reduce the problems associated with integrated antenna fixed radio access terminals and to provide a design that optimises the combination of the antenna and a circuitry box.

SUMMARY OF THE INVENTION

In accordance with the invention, there is provided an integrated antenna and subscriber terminal for a wireless communications system, wherein there are provided two antennas and wherein one antenna is a quarter wave monopole and the other antenna is a folded monopole. In accordance with another aspect of the invention, there is provided a wireless subscriber terminal comprising: a quarter wavelength monopole first antenna; a folded monopole second antenna; and a ground plane having a surface angled with respect to the horizontal, wherein the ground plane has an axis a quarter of a wavelength long extending from a feed point for the first antenna and is electrically symmetrical about the axis.

Preferably the first antenna is positioned in a vertical plane passing through the axis. Preferably, the quarter wave monopole is operable to receive and transmit signals omnidirectionally in azimuth and the second antenna is operable to provide receive diversity and has an axis parallel with the axis of the ground plane. Preferably, the main antenna has an elevated feed point with respect to its base. The second antenna can be internally bent folded monopole, although other types of top-loaded antennas may be employed, such as a planar inverted F antenna could be used. Preferably, the main antenna is used for transmit and receive, and a second antenna is tuned to the receive band only and used for receive diversity. Preferably, the second antenna has a feed point not less than 0.2 wavelengths removed from the feed point of the first antenna. The feed point of the second antenna can be mounted on a side surface associated with the ground plane. The wireless subscriber terminal control electronics can be enclosed by a structure which forms the ground plane. Preferably the second antenna is internally mounted relative to a plastics cover. This gives a resonant antenna that has a low profile that can have a high radiation efficiency and is tamper/damage resistant.

The wireless subscriber terminal can be arranged for use on flat surfaces such as table tops and the like, with the terminal having a support whereby the ground plane is angled with respect to the horizontal. Preferably, the axis of the ground plane is oriented at an angle in the range of 20–90° to the horizontal, even more preferably at an angle of the order of 40° to the horizontal (when employed in a desk mount mode), whereby a proportion of the vertical component of the diversity antenna and ground plane are projected in the azimuth plane. Preferably the first antenna is movably mounted whereby the angle of the antenna is between ±40° to the vertical, even more preferably at an angle of the order of 20° to the vertical; a multi-position bayonet aerial connector arrangement can be employed. Preferably, the wireless subscriber terminal can be arranged for use on vertical surfaces such as walls, cupboards and the like, with the terminal having a support whereby both the first antenna and ground plane are vertical.

In accordance with another aspect of the invention, there is provided a method of operating a wireless subscriber terminal comprising: a quarter wavelength monopole first antenna; a folded monopole second antenna; and a ground plane having a surface angled with respect to the horizontal, wherein the ground plane has an axis a quarter of a wavelength long extending from a feed point for the first antenna and is electrically symmetrical about the axis wherein, in a receive mode, the method includes the steps of receiving signals through both antennas, wherein mutual coupling effects between the first antenna and the second antenna and between the first antenna and the casing are reduced.

DETAILED DESCRIPTION OF PREFERRED EMBODIMENTS

Figure 1:
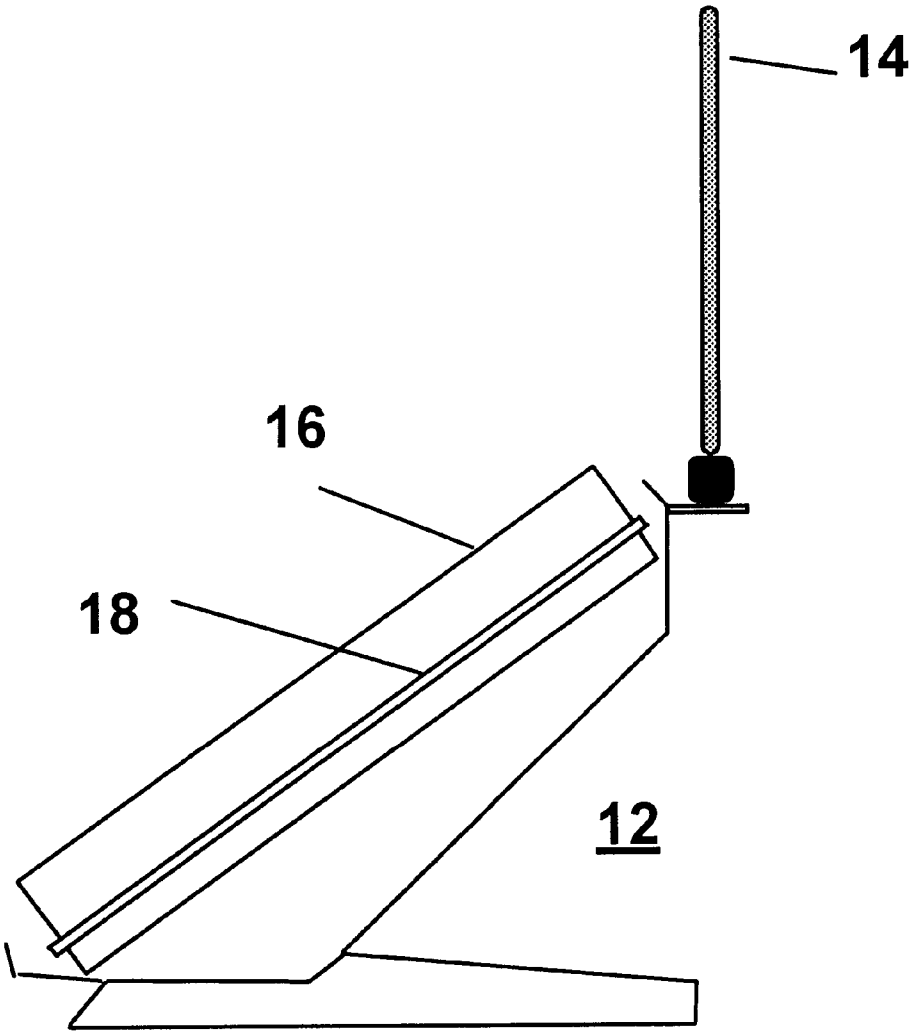
FIG. 1 shows a first design of integrated terminal, with the antenna in a first position.
Figure 2:
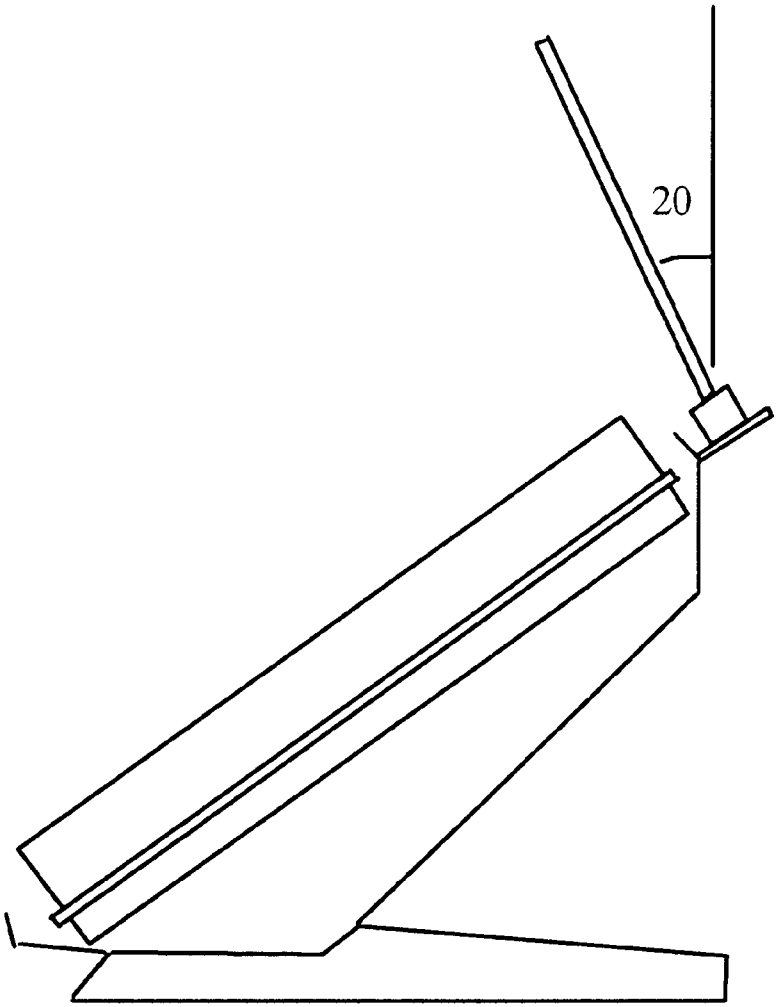
FIG. 2 shows the design of FIG. 1, with the antenna in a second position.

FIGS. 1 and 2 illustrate a first embodiment of the invention 10, showing a side view of a terminal 12 detailing a main antenna 14. The terminal includes circuitry enclosed in a shielded box 16 having a top surface 18 angled at 40° to the horizontal. A second receive diversity antenna is situated in the same plane as the shielded box, along one side of the terminal (not shown). The monopole is 13 cm long with a feed point at the base: in FIG. 1 the main antenna is vertically oriented whilst in FIG. 2 the main antenna is angled at 20° to the vertical. The main antenna is predominantly vertically polarised and is omnidirectional. The monopole can be shorter in length than a quarter wavelength of the nominal centre frequency due to impedance loading and other effects. The shielded box is only exemplary: the ground plane could be remote from the shielded box, but in order to produce a compact design, it is best to make use of the shielded and hence grounded box. The printed circuit board 20 is shown protruding through the side of the can. Conventional shielding techniques such as the use of compartmentalised sections, plated through holes and the like can readily be employed. The diversity antenna can be printed on this printed circuit board for ease of fabrication in addition to enabling the antenna to be in a plane parallel with the ground plane.

Figure 3:
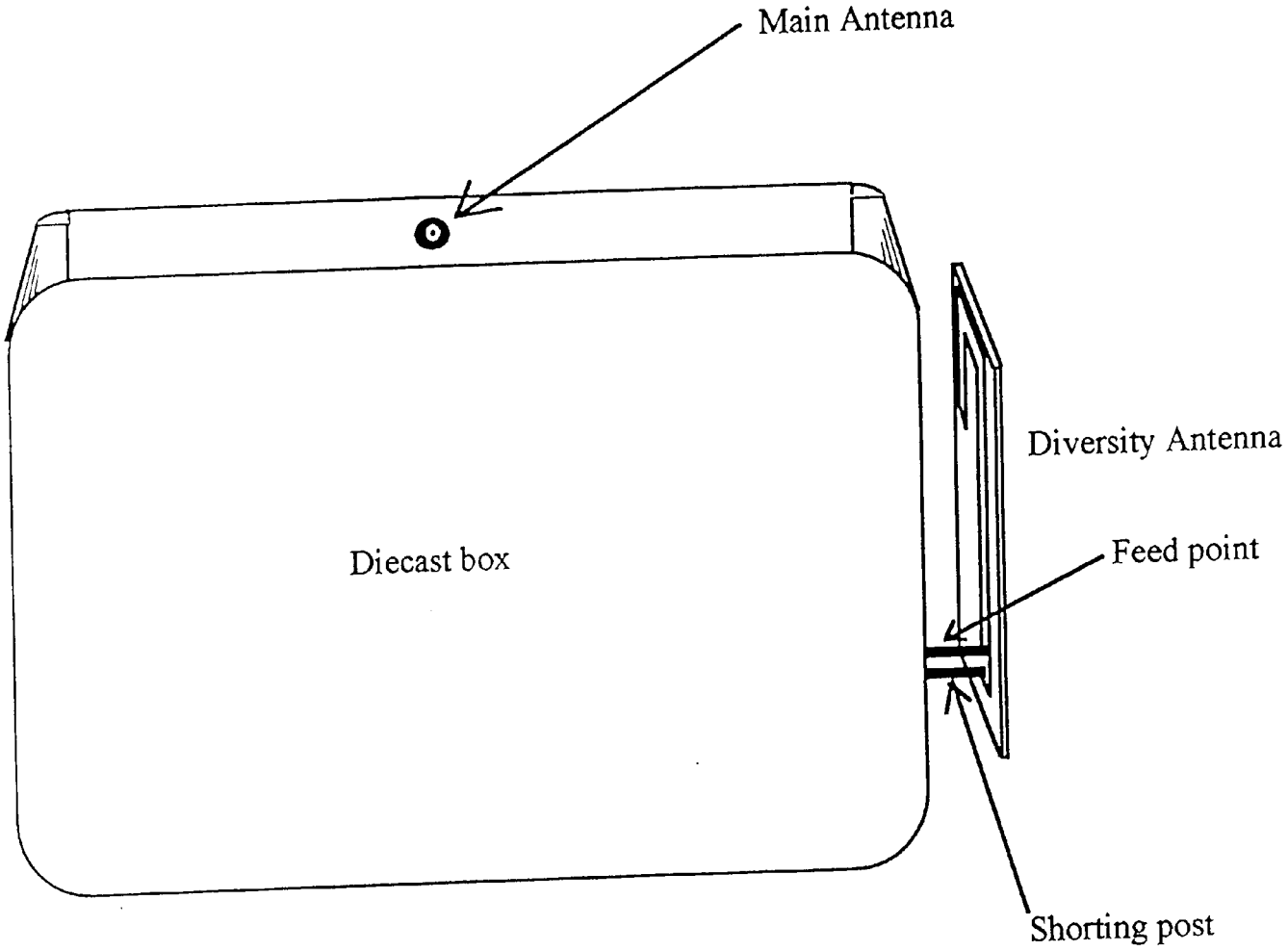
FIG. 3 shows a terminal having a diversity antenna and the feed point of the main antenna.

Referring now to FIG. 3, a diversity antenna 22 is detailed, which antenna takes the form of a quarter wavelength bent folded monopole. In simple terms, a bent folded monopole is a folded monopole where the major part of it is bent over to run parallel to a ground plane. This gives a resonant antenna that has a low profile that can have a high radiation efficiency. Whilst the low profile reduces the bandwidth attainable, this is not of any consequence because it is employed for receive diversity, where a limited bandwidth is sufficient.

Figure 4:
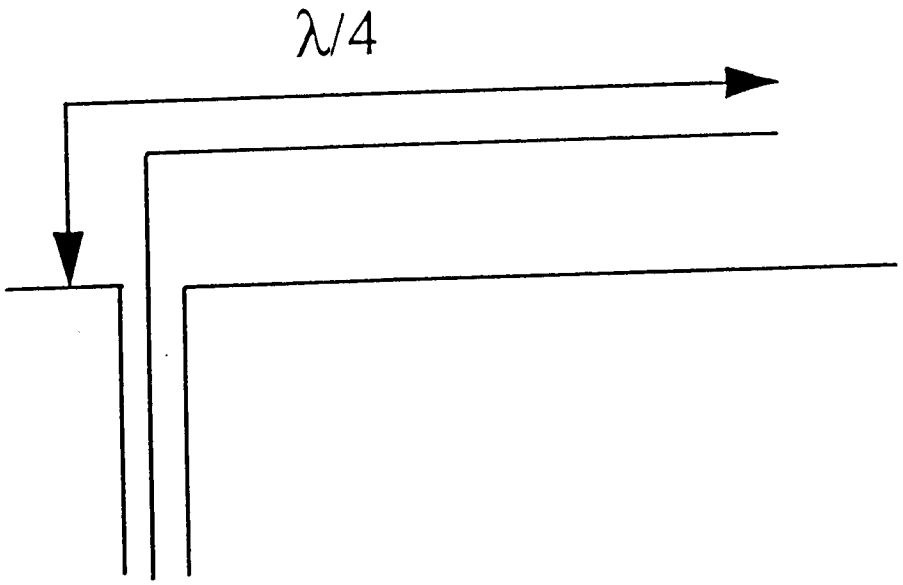
FIG. 4 shows a first type of inverted L antenna element.
Figure 5:
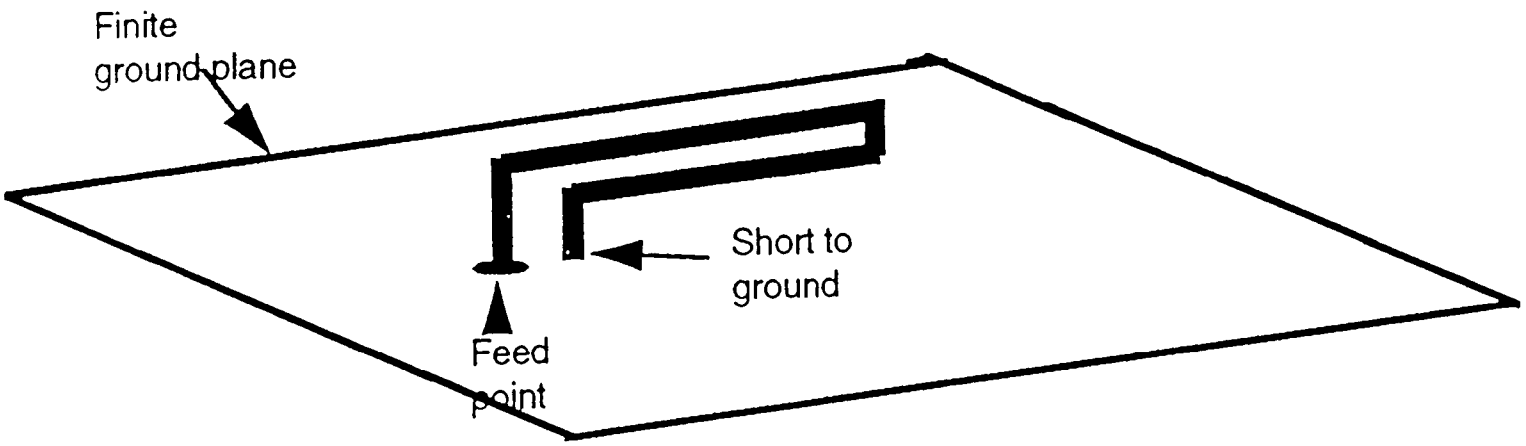
FIG. 5 shows a bent folded monopole.

The height of the bent folded monopole is 25 mm, which corresponds approximately to 0.04 $\lambda$. The section of the antenna parallel to the ground plane forms an image in the ground plane such that a twin wire transmission line is formed. The line is effectively open circuited at one end (the end furthest from the feed), and since the antenna is a quarter of a wavelength in length this helps to maximise the current in the short antenna section perpendicular to the ground plane which, in turn, helps to maximise the radiation resistance and hence the radiation efficiency. FIGS. 4 and 5 show an inverted L antenna and a bent folded monopole respectively. The bent folded monopole is connected to radio circuitry using wires soldered to the opposite ends of the antenna; a first wire is connected to the feed line whilst the second is connected to ground.

Figure 6:
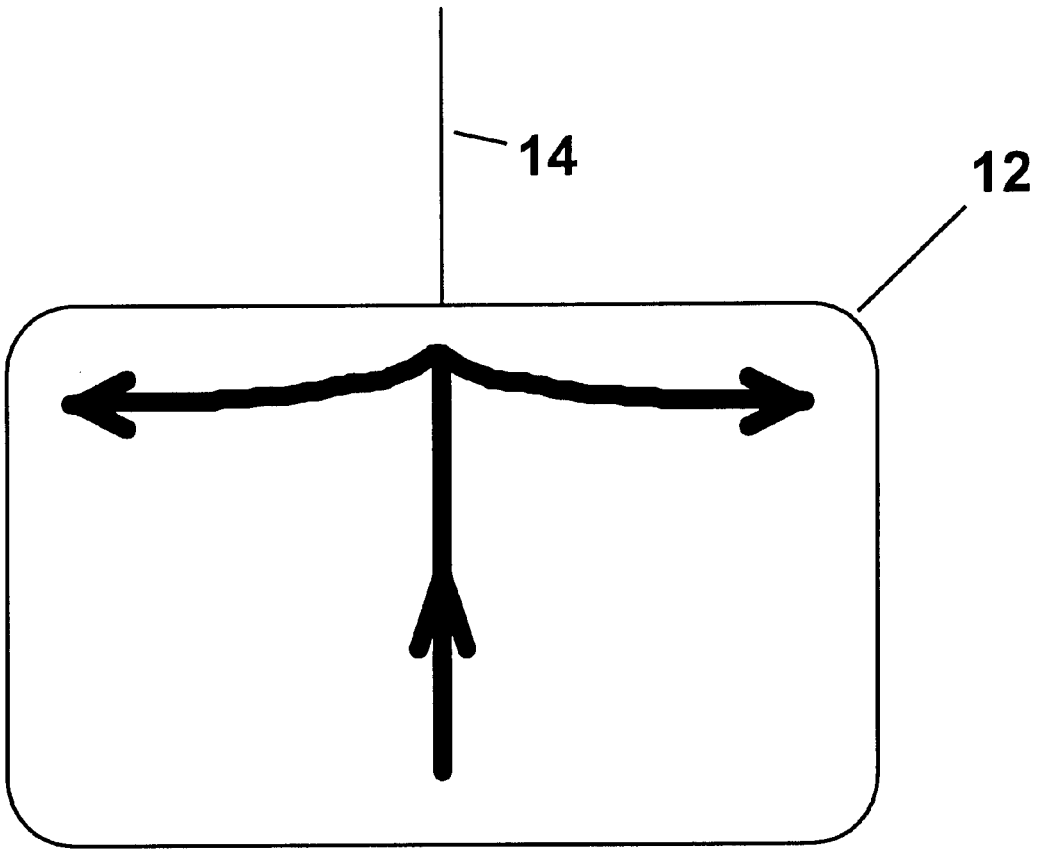
FIG. 6 illustrates the induced currents on the body of the terminal of FIG. 1.

FIG. 6 shows the axial (as determined from the feed point for the main antenna) current induced along the surface of the electronic casing. In azimuth, the radiation pattern is similar to a dipole. This embodiment has a terminal case length similar to the length of the monopole antenna itself; the length is close to a resonance at the frequency of operation. A strong vertical current is therefore excited along the surface of the box so that it acts like the other half of a dipole. By having a pronounced tilt to the terminal body of 40°, (in the desk top version) there is a significant projection of a vertical component in the azimuth plane. For the wall mounted version, the main antenna and the ground plane are both vertically oriented. The horizontal currents in both the desk and wall mounted versions tend to cancel due to the central location of the monopole.

Figure 7:
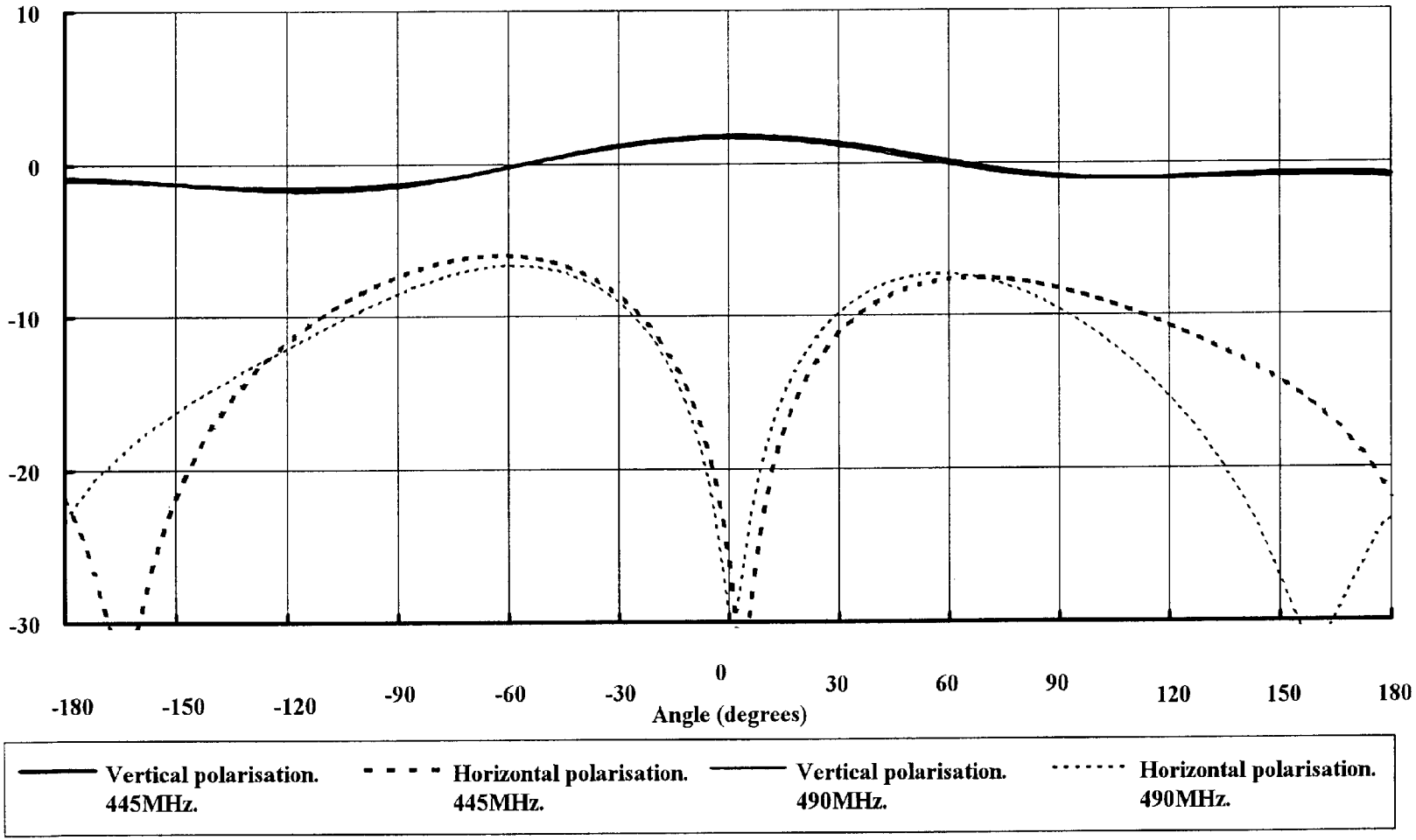
FIG. 7 shows measured azimuth radiation patterns for the main antenna.

Measurements were made of azimuth radiation patterns for the desk mounted terminal, with the monopole vertical, and radiation patterns at 445 MHz and 490 MHz are shown in FIG. 7. The azimuth ripple at 445 MHz was measured to be 3.6 dB and the azimuth ripple at 490 MHz was measured to be 3.2 dB, which is about 1 dB higher than predicted. The peak gain measured for the antenna was 1.9 dBi at 445 MHz and 1.7 dBi at 490 MHz, and the gain averaged over the azimuth plane was −0.1 dBi at 445 MHz and −0.2 dBi at 490 MHz. The plot show the cancellation of the horizontal component at 0° due to the central mounting of the antenna.

Figure 9:
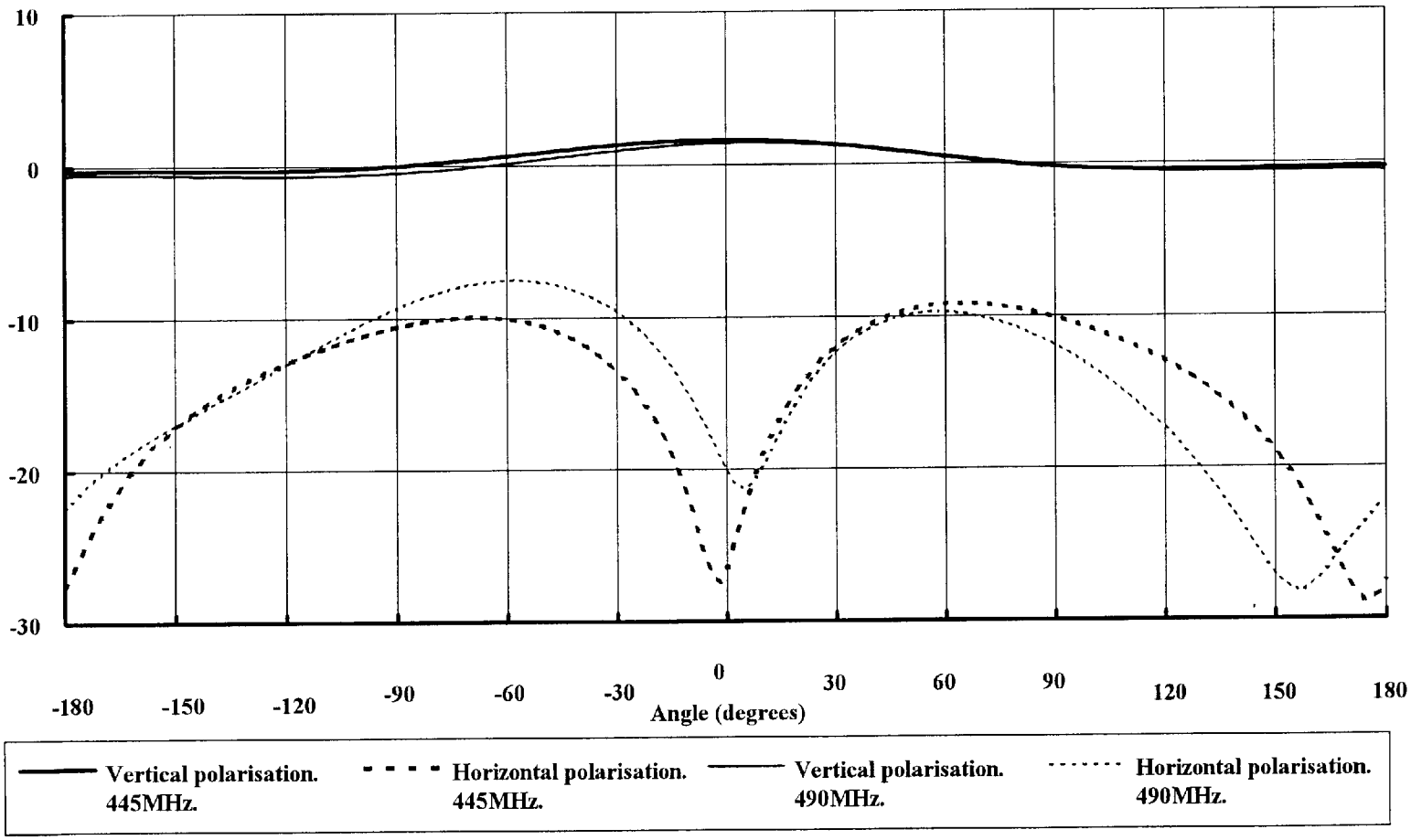
FIG. 9 shows the azimuth radiation pattern for the main antenna tilted forwardly by 20°.

FIG. 9 shows a predicted elevation pattern for a vertical monopole. There is no horizontal polarisation component in the elevation plane and there is a resemblance in the pattern shape to a dipole, except that the peaks and nulls have been shifted in angle. One of the two pattern peaks occurs at 90°, which is the forward 'broadside' direction and is in the azimuth plane. A vertical dipole would also have a peak at this point. However, there is no corresponding peak at the reverse 'broadside' direction, −90°, and the second peak is at approximately −120°. The changes are due to the relative phase between radiation from the vertical monopole and radiation from the terminal body. The ripple in the azimuth plane is due to the skewing of this second peak from the −90° direction.

In order to shift the elevation plane peaks back to the ±90° directions (azimuth plane) the monopole was tilted 20° forwardly towards the ground plane. The 20° tilt resulted in a change of impedance and to compensate this a new monopole was made having a length of 150 mm and consisting of a TNC connector with a length of 1 mm diameter tinned copper wire. The configuration is as shown in FIG. 2. The antenna can easily be adjusted in position using a multi-position bayonet type connector.

Figure 8:
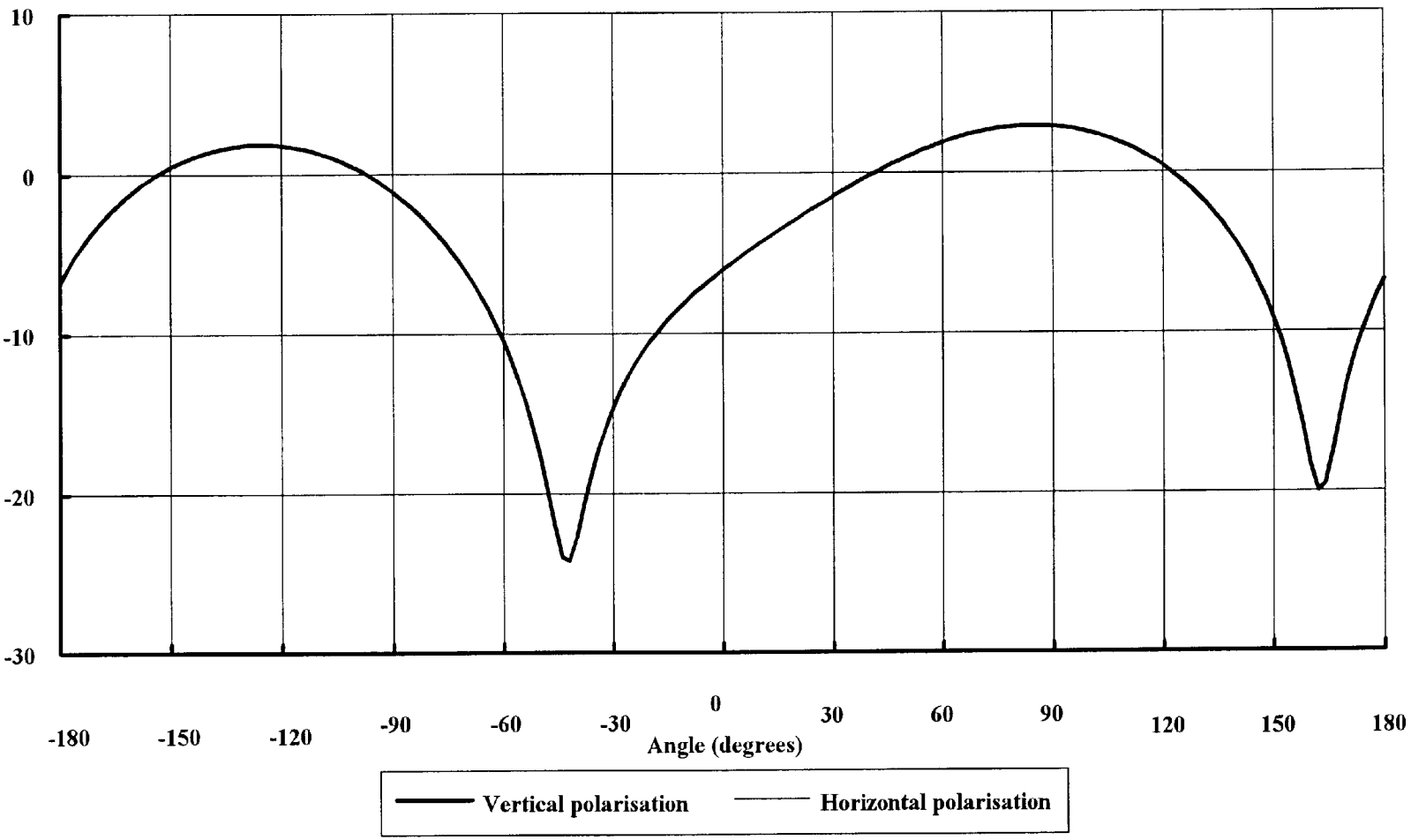
FIG. 8 shows a predicted elevation pattern for a vertical monopole.
Figure 10:
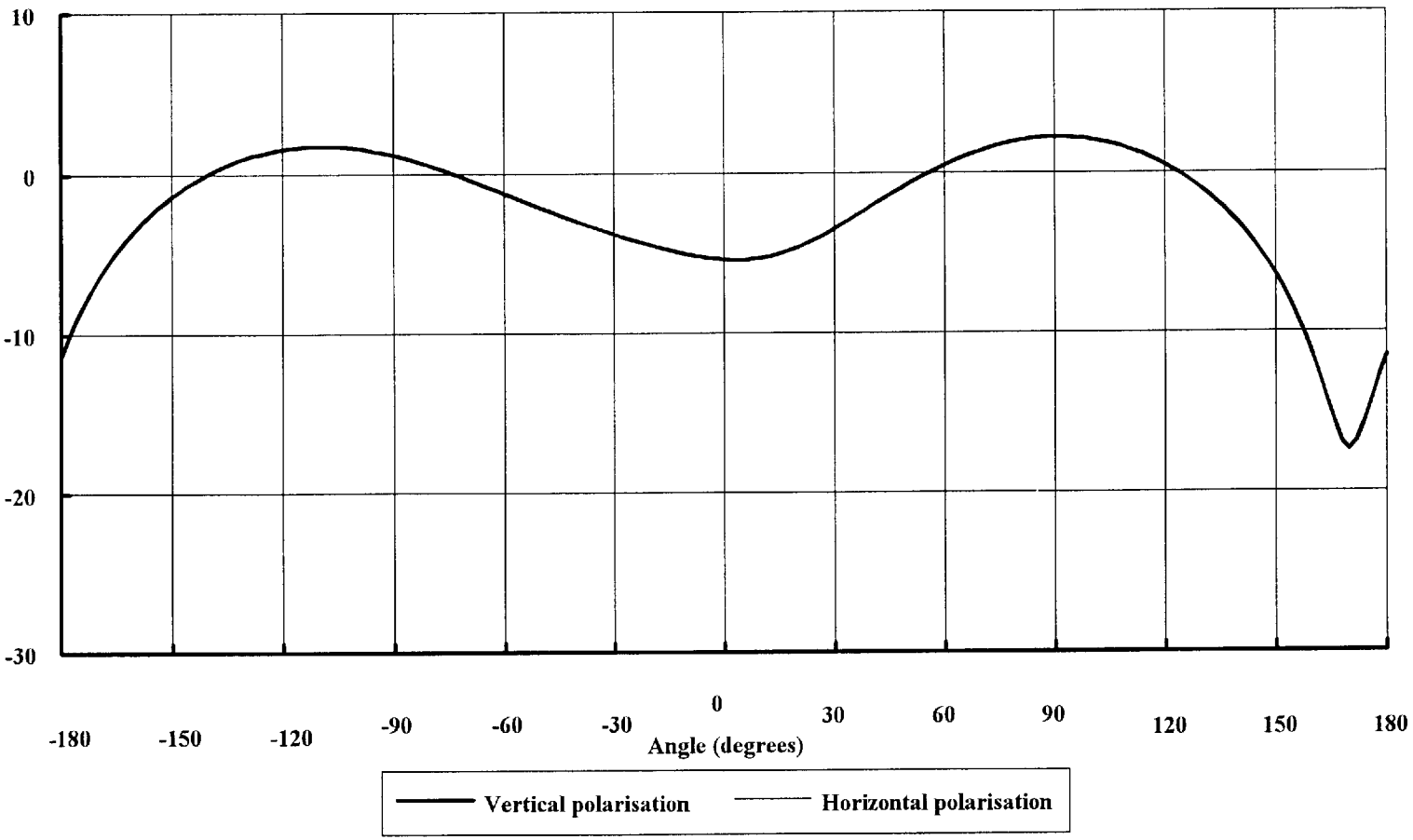
FIG. 10 shows a predicted elevation pattern for a tilted monopole.

Accordingly, FIG. 9 shows a plot similar to FIG. 7 but with the antenna tilted 20° towards the ground plane. For this case the azimuth radiation patterns were again measured at 445 MHz and 490 MHz. The azimuth ripple for this case was measured to be 2.1 dB at both frequencies; the horizontal polarisation is lower for the case where the monopole is tilted forward by 20°. The peak gain was measured to be 1.6 dBi at 445 MHz and 1.5 dBi at 490 MHz and the average gain was 0.4 dBi at 445 MHz and 0.1 dBi at 490 MHz. Therefore, although the peak gain is lower for this case, the average gain is higher and the angular variation is decreased. FIG. 10 shows a predicted elevation pattern, similar to FIG. 8, for a tilted monopole. When the terminal was vertically oriented, the azimuth radiation pattern for this case was measured at 445 MHz and 490 MHz, with the patterns being vertically polarised and omnidirectional.

Figure 11:
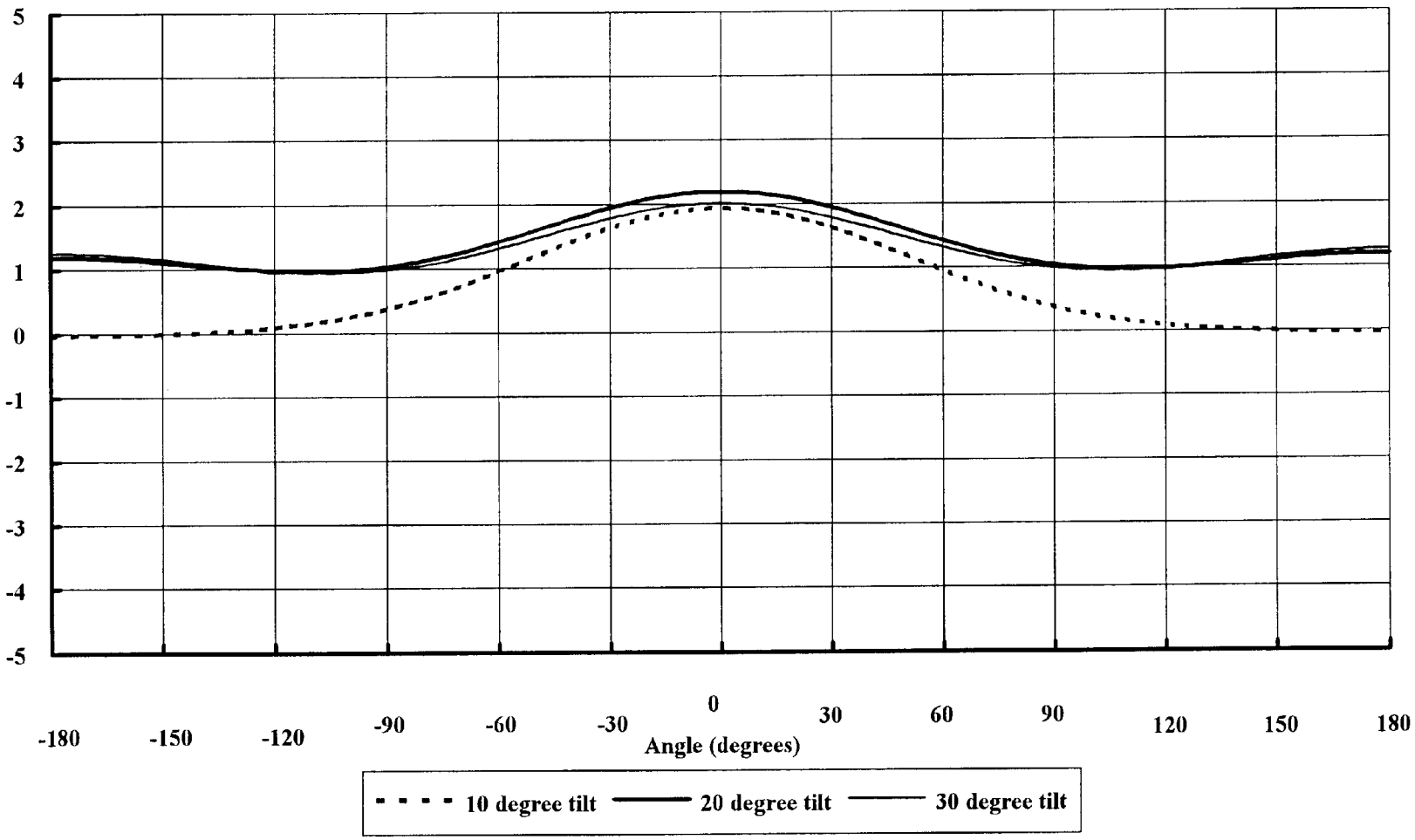
FIG. 11 shows the azimuth ripple patterns for the main antenna having 10°, 20° and 30° tilt angles.

FIG. 11 shows the predicted azimuth ripple patterns only for the main antenna tilted forwardly 10°, 20° and 30° towards the ground plane from the vertical. The ripple for a 10° tilt was 1.97 dB, the ripple for a 20° tilt was 1.24 dB and the ripple for a 30° tilt was 1.08 dB. These results show that an improvement in the azimuth ripple pattern can be gained using a 20° tilt, where the average gain was 1.4 dBi. This is 1 dB higher than that obtained using a vertical monopole, and the minimum gain improved by 1.5 dB. The results show that most of the benefit has been achieved at 20° and tilt angles beyond this provide no further appreciable benefit.

The maximum return loss with the main antenna mounted 20° forwardly towards the ground plane was 15 dB, with a 65 MHz 10 dB return loss bandwidth (13.9% for 467.5 MHz centre frequency). Again the antenna was merely trimmed in length until a return loss of greater than 10 dB was obtained across the operating band. This gave a mismatch loss of less than 0.45 dB.

The return loss of the main antenna depends on the actual feed point location on the terminal. In order to investigate the sensitivity of the input impedance to the feed location, further simulations of the antenna were made, employing time domain analysis, to obtain wide band impedance data.

Figure 12:
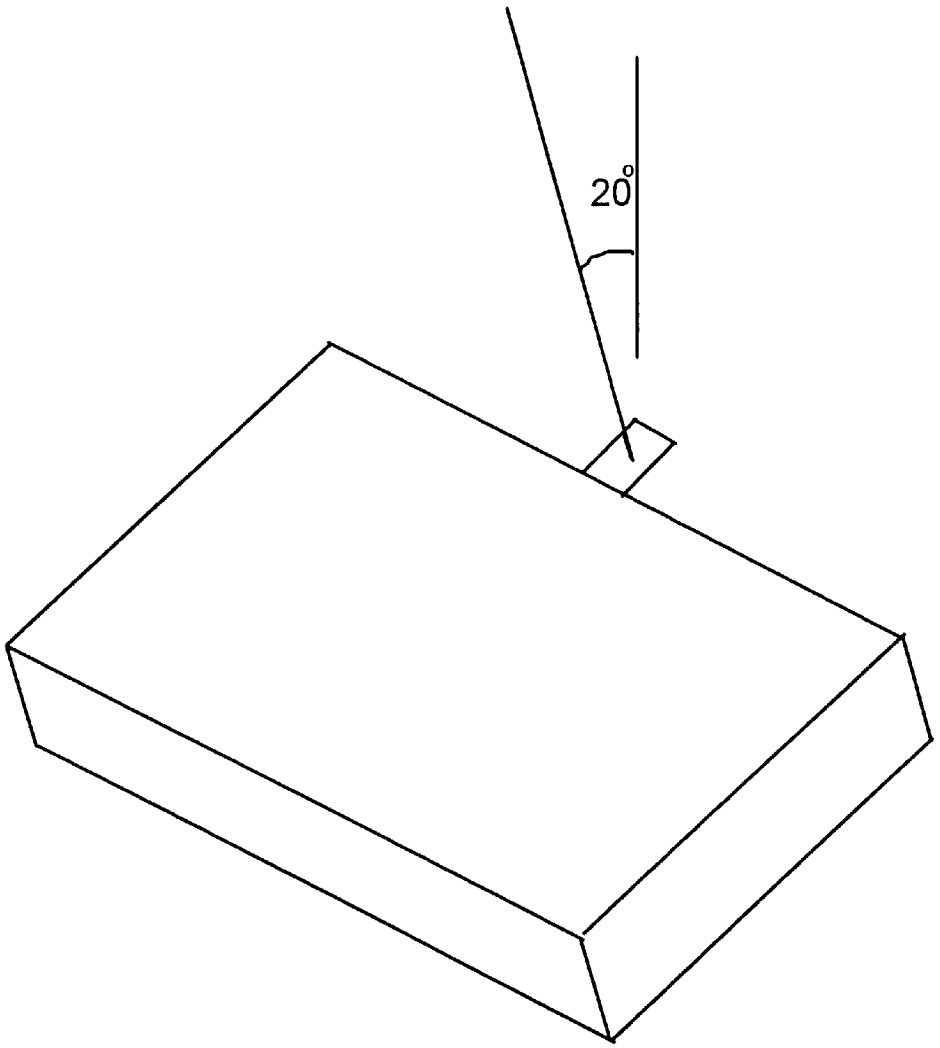
FIG. 12 shows a first terminal model used for input impedance simulations.
Figure 13:
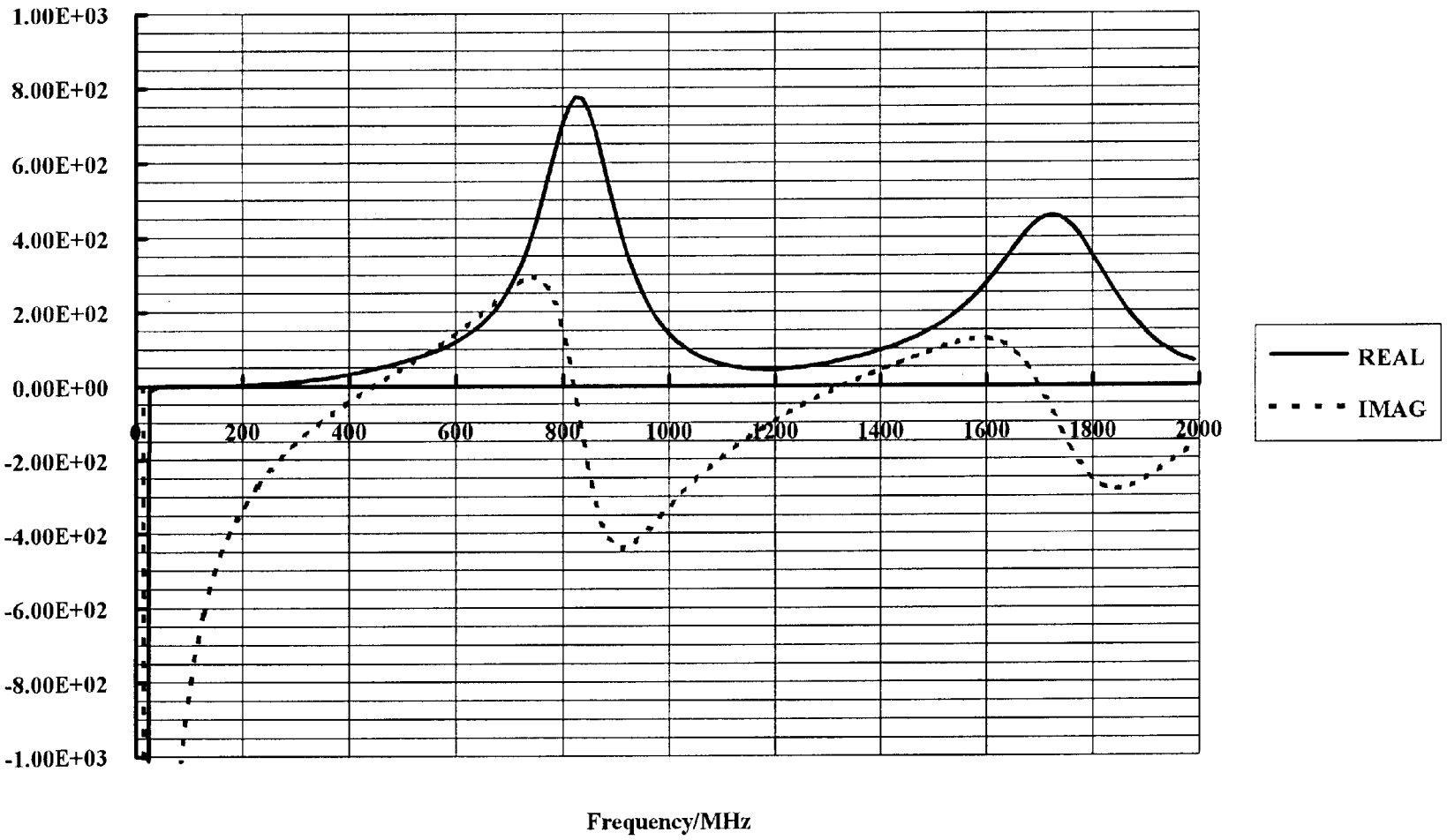
FIG. 13 represents the input impedance for the model of FIG. 12.
Figure 14:
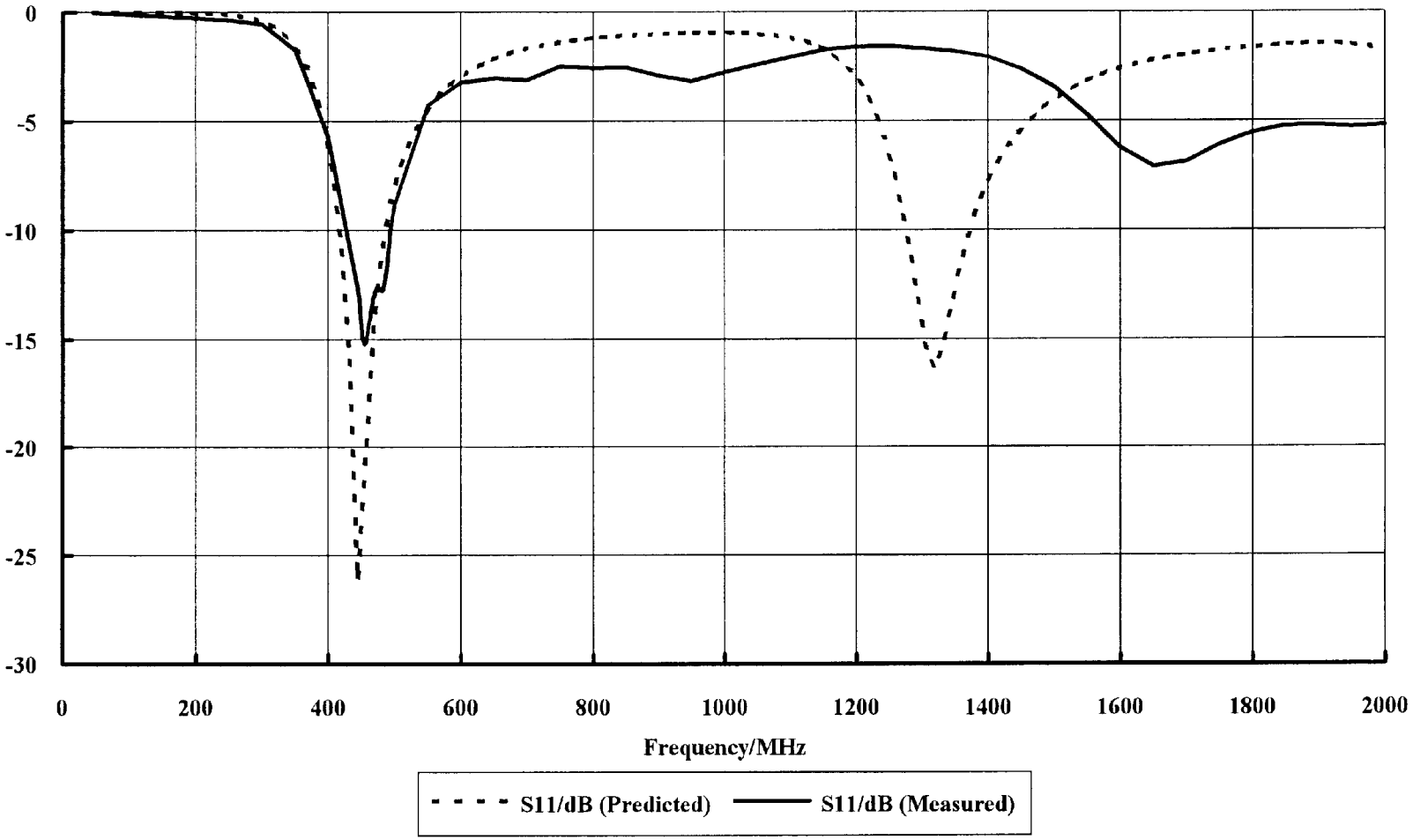
FIG. 14 represents the return loss for the model of FIG. 12.

The first model to be investigated is illustrated in FIG. 12 and has the feed point at the base of the monopole, so the impedance seen at the terminals at the third harmonic is simply the radiation resistance. The predicted impedance for this model is plotted against frequency in FIG. 13. The prediction shows a second resonance just above 1.3 GHz, at the third harmonic. The antenna length is 0.75λ at this frequency; a current maximum occurs at the base of the antenna, and the reactive part of the impedance goes to zero. Consequently, the impedance match to the feed line depends on the radiation resistance (or the current maximum) on the antenna. FIG. 13 shows that the radiation resistance is predicted to be about 70 Ω, giving a return loss of 15.6 dB, as can be determined by FIG. 14.

Figure 15:
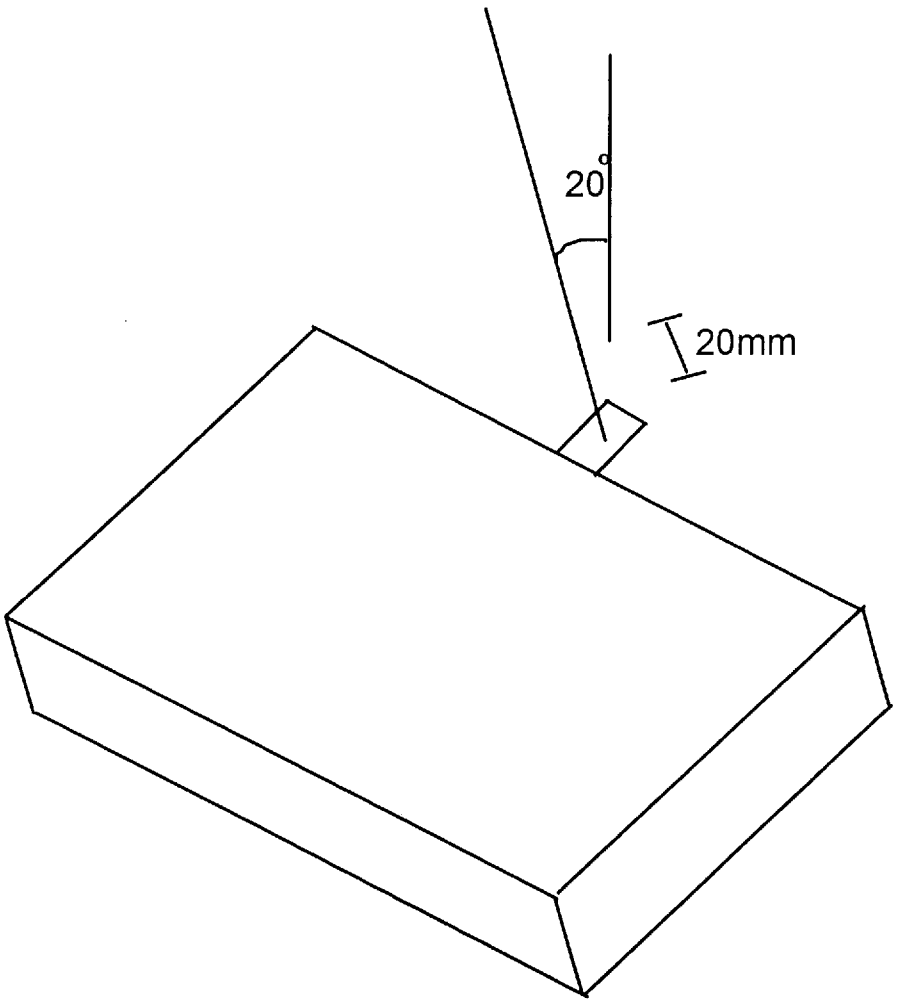
FIG. 15 shows a second terminal model used for input impedance simulations.
Figure 16:
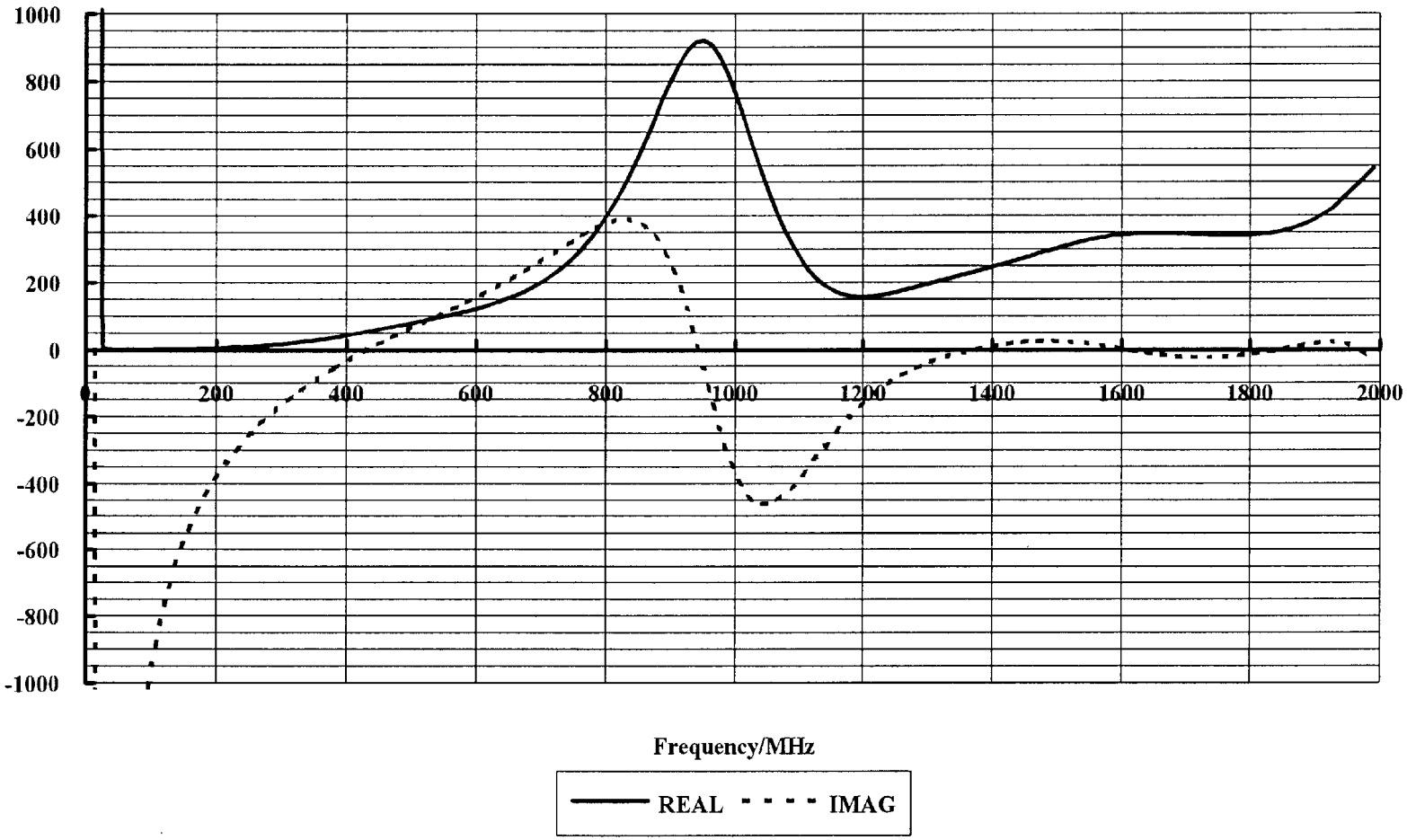
FIG. 16 represents the input impedance figures for the model of FIG. 15.
Figure 17:
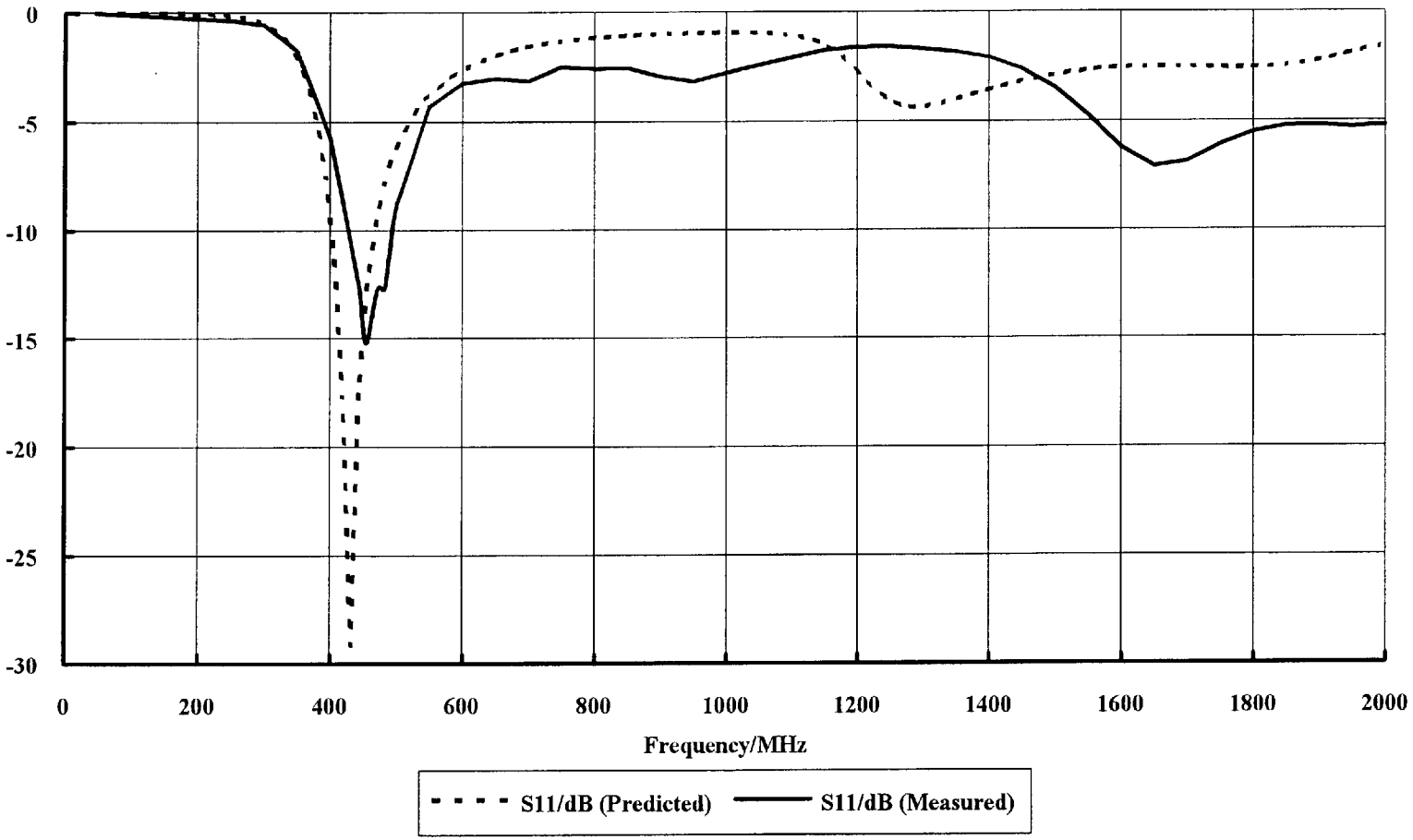
FIG. 17 represents the return loss for the model of FIG. 15.

To reduce the return loss, a further model was investigated with the feed point raised 20 mm from the base of the antenna and this is illustrated in FIG. 15. The predicted impedance variation with frequency is shown in FIG. 16, and the corresponding S11 plot assuming a 50 Ω feed line is shown in FIG. 17. The resistance at the third harmonic is much higher (200–250Ω); the return loss at the third harmonic is much lower (<5 dB) which is more in line with the measurement. It can be seen that the input resistance will be higher for the displaced feed point by considering the current distribution along a monopole. Thus, the use of an elevated feed point improves the antenna out-of-band performance. It is to be noted that, in practice, the axis of the monopole does not cross the back edge of the ground plane and will be displaced about 10 mm.

The total radiated power of an antenna was measured by measuring the radiation pattern over the sphere surrounding the structure, and integrating to get the total radiated power. The pattern measurement is performed by taking a number of great circle cuts at regular angular intervals. An interval of 10° was used for these measurements to compute the overall radiation efficiency. Ideally, the peak gain should be less than 3 dBi for the azimuthal radiation pattern, whilst the vertical polarisation for the main antenna in the azimuth plane should have a mean gain less than 0 dBi.

Diversity action is achieved between the antenna elements with a combination of space and polarisation diversity. The folded monopole in combination with the main dipole antenna provides this effect. A further effect of the arrangement is that the diversity element can be spaced at a reduced distance away from the main antenna. This feature enables the separation of the feed points from these antennas to be lower than 0.2λ, with adequate results being obtained with a separation of 0.18λ. Typically, in indoor installations, in order to obtain spatial diversity, a spacing of at least 0.4λ is required. The feed point for the diversity antenna is positioned on the circuitry box close to the side from which the feed point for the main antenna emanates. Results are given at 490 MHz since this particular diversity element is used in the receive band (485–495 MHz), but similar effects will occur at other frequencies.

Figure 18:
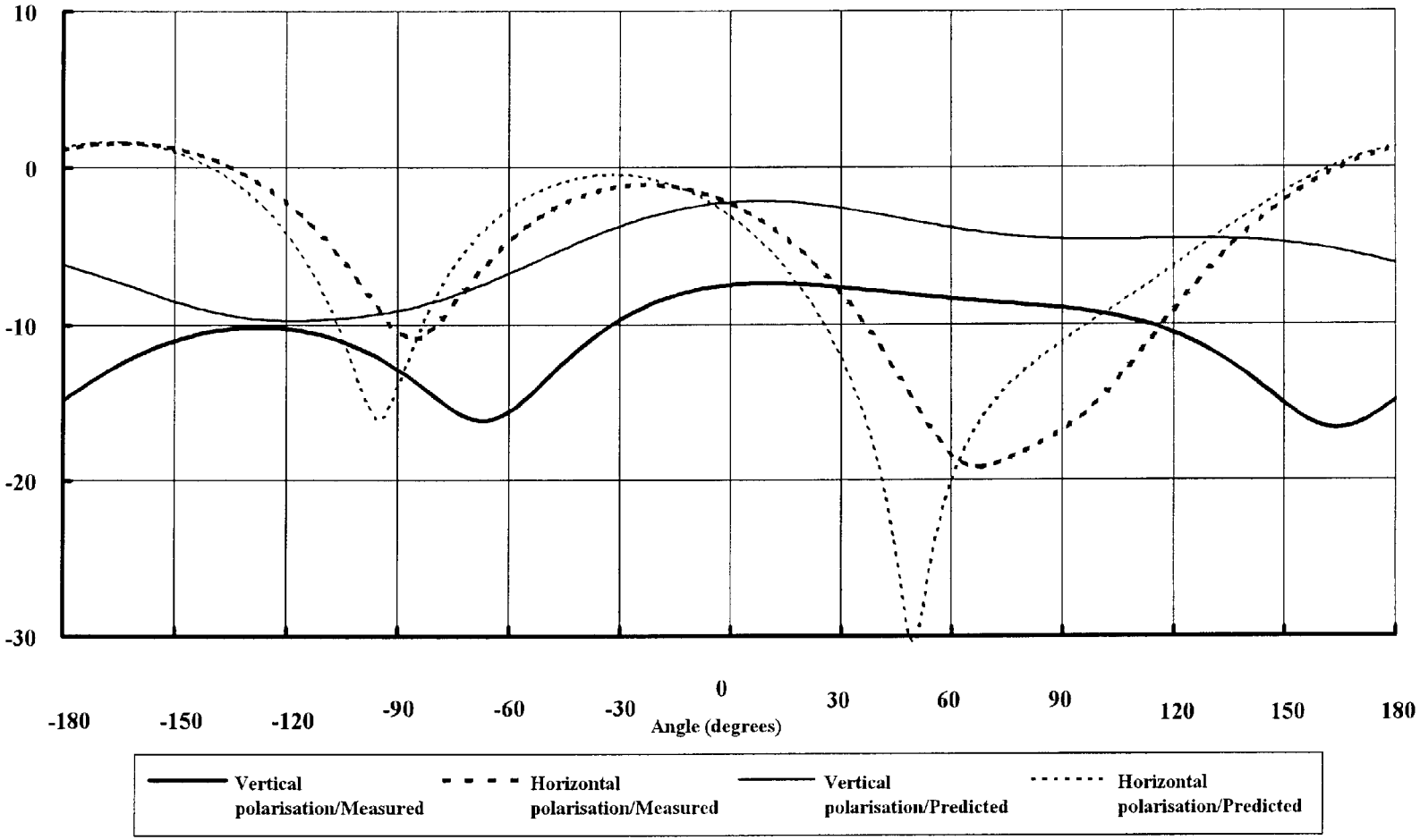
FIG. 18 shows predicted and measured azimuth radiation patterns for the diversity antenna in a desk mounted position at 490 MHz.
Figure 19:
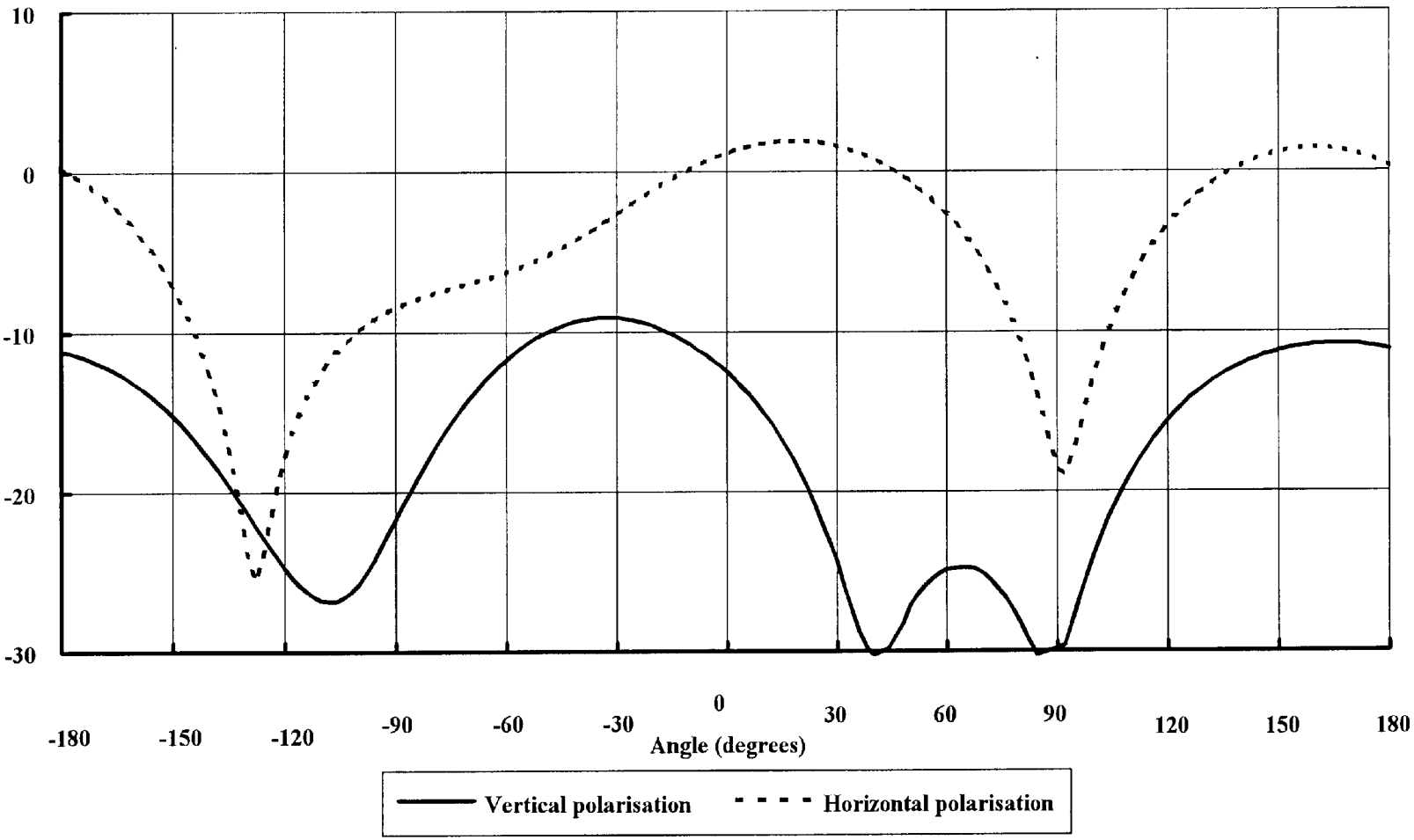
FIG. 19 shows the measured azimuth radiation pattern for the diversity antenna in a wall mounted position.

The azimuth radiation pattern for the diversity element of FIG. 3 was measured for both desk mount and wall mount orientations as shown in FIGS. 18 and 19: the return loss was not optimised—the element was approximately tuned to achieve an adequate match in the band of interest to enable some basic radiation performance measurements to be made. The maximum return loss was 11.4 dB at 487 MHz, and the element had a 5 dB return loss bandwidth of 70 MHz. In the case of the desk mount, there can be seen a strong horizontal component in the radiation pattern. Therefore, for this configuration diversity action will also be achieved through a combination of space and polarisation diversity. In the case of the wall mount orientation, with the main antenna vertical the horizontal component is also strong. Note that a terminal plastics cover will have a loading effect on the element and consequently a different type of housing will affect the tuning. The fitment of a plastics cover caused the resonant frequency of the element to drop and the length of the trombone section was shortened in order to re-tune the element to 490 MHz.

Figure 20:
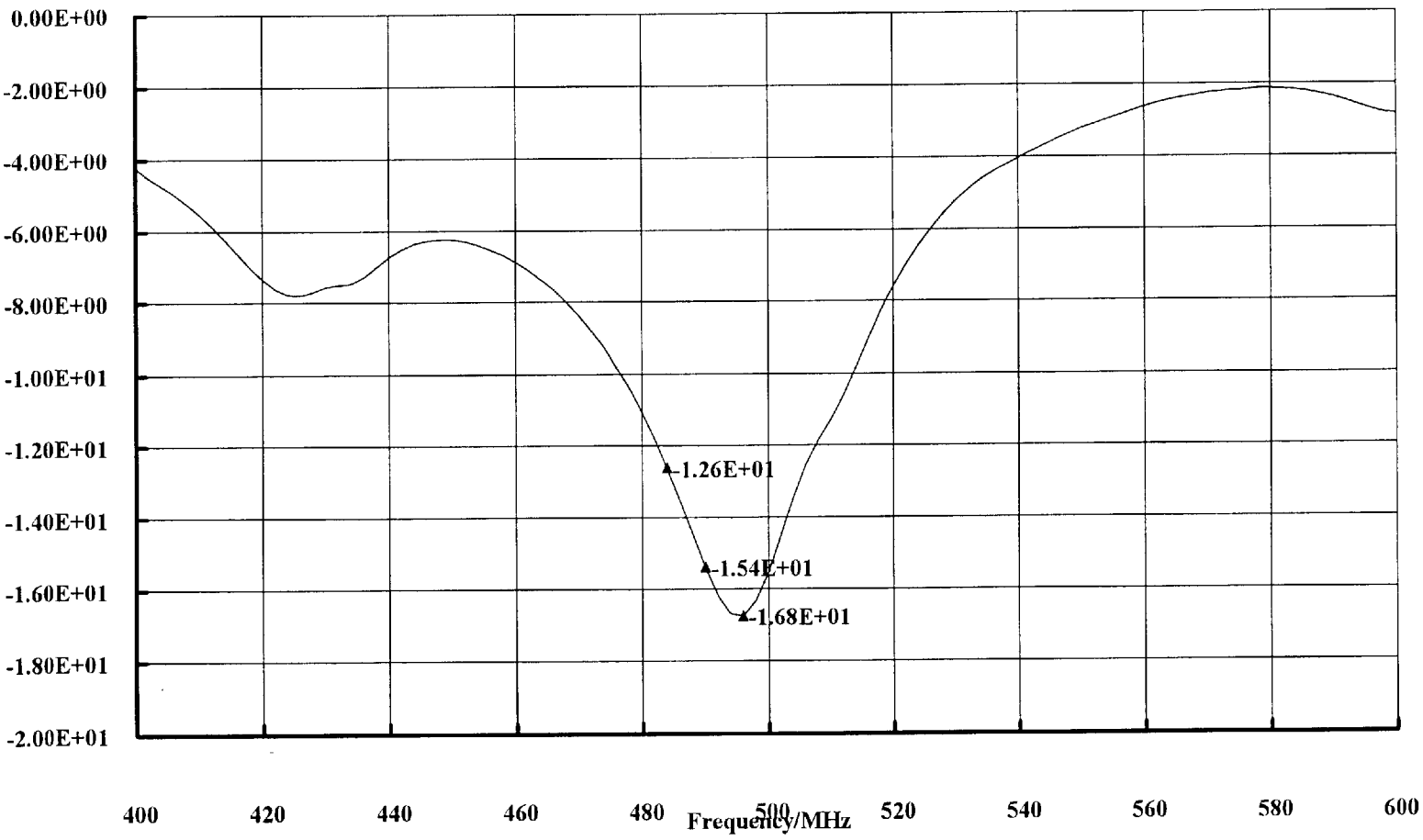
FIG. 20 shows the measured return loss for the diversity antenna.

The measured return loss for the element shown in FIG. 3 is plotted in FIG. 20. In this plot the three data points shown correspond to 484 MHz, 490 MHz, and 496 MHz. The return loss is greater than 12 dB at all points (i.e. across the operating band). The 10 dB return loss bandwidth was measured to be 38 MHz, and the 5 dB bandwidth is 126 MHz. The 5 dB bandwidth is much larger than that recorded for the element without a plastics cover. This is because there appears to be a second resonance at approximately 425 MHz, and this is not present when the cover is removed.

A complete set of radiation pattern measurements was made for the diversity element covering the entire radiation sphere. These were obtained in the same fashion as the for the main antenna. The diversity element was excited from a battery powered source housed inside the shielding can on the terminal prototype. Measurements were made at 474 MHz with the element re-tuned to give a good match (>10 dB) at this frequency. No plastics cover was present during these measurements. The directivity for the element was estimated to be 3.6 dBi, the peak gain was measured to be 2.82 dBi and so the radiation efficiency is estimated as −0.78 dB (83.5%).

Figure 21:
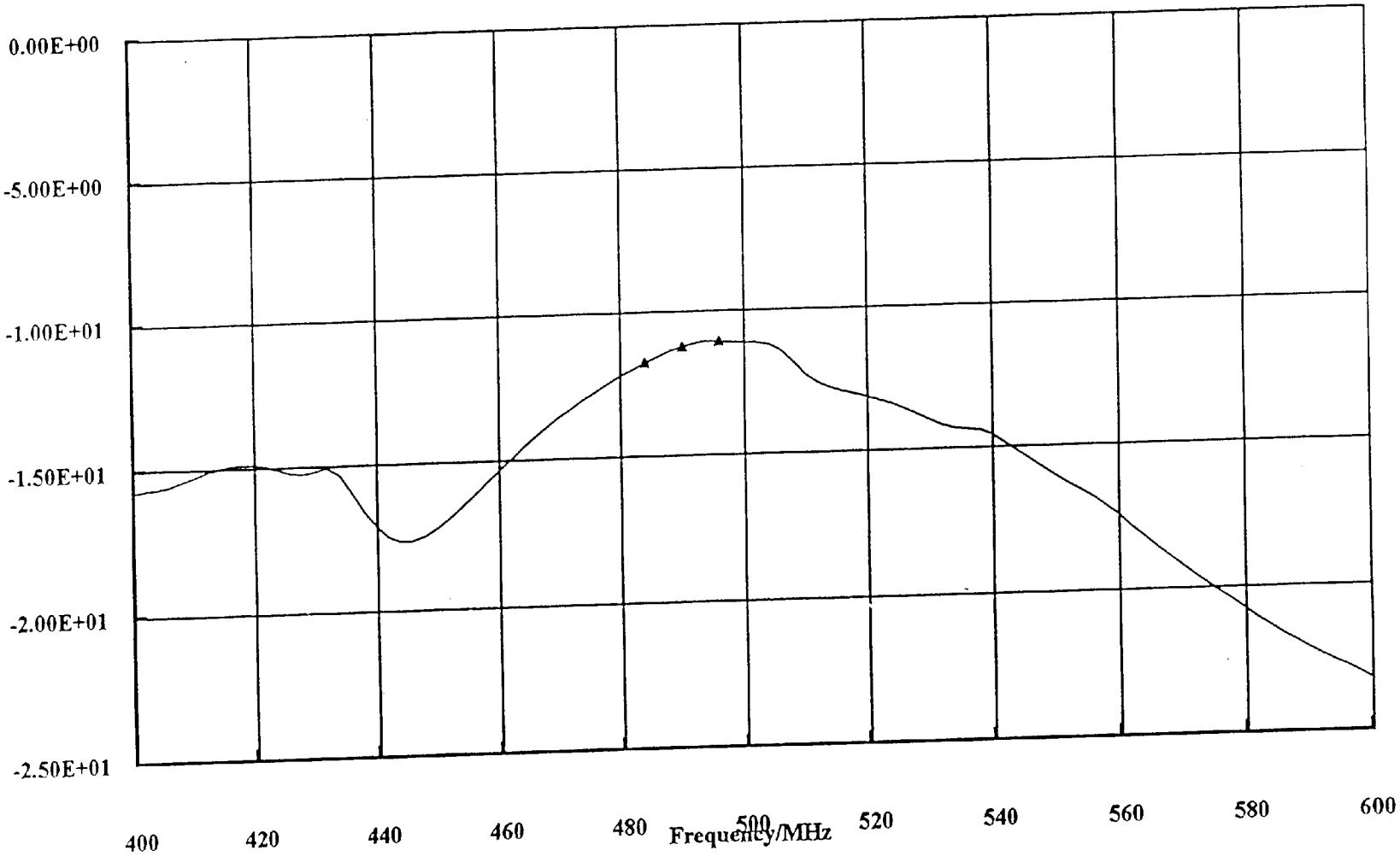
FIG. 21 shows the measured isolation between the main and diversity antenna elements.

The isolation has been measured between the main and diversity elements. This is shown in FIG. 21. The three data points shown are once again at 484 MHz, 490 MHz, and 496 MHz. The plot shows that the isolation is greater than 10 dB across the receive band. Note that the diversity element had the plastics cover on for this measurement.

During the analyses of the antennas under test, all sources of error were reduced as much as possible. It is undesirable to attach test cables to the structure because surface currents are induced on the outer conductor of the cables, and this interferes with the radiation pattern. Since the position of the test cable relative to the structure varies as the structure is rotated for each new great circle cut, the radiation pattern effectively changes for each new cut. This is a source of error and can be eliminated by mounting a battery powered transmitter on the actual structure. This was carried out for the pattern measurements, where the transmitter and batteries were housed inside the shielding can. Consequently, their presence had no consequence with respect to the radiation properties of the terminal.

The ground plane ideally forms part of the enclosure for the central electronics: a rectangular shape with a feed point for the main antenna along the midpoint of one side is not the only shape possible; the ground plane could be triangular with the feed point for the main antenna either at an apex or a midpoint along one side. Models have been produced which do not have a particularly flat surface; it is sufficient that there is an axis and the currents induced either side of the axis approximately cancel. The length of the axis should be close to a quarter of the wavelength of a resonant frequency of operation. The ground plane to which the main antenna is attached may extend rearwardly of the mounting position provided that the axial length forward of the main antenna mount is of the order of a quarter of a wavelength, but any such extension can compromise the +90° through ±180° to −90° sector azimuth radiation pattern. Other types of top loaded antennas could, of course be employed for the second antenna to achieve diversity action; a quarter wavelength planar inverted F antenna could be used, for example.

What is claimed is:

1. A wireless subscriber terminal comprising:

a quarter wavelength monopole first antenna;

a folded monopole second antenna; and a ground plane having a surface angled with respect to the horizontal, wherein the ground plane has an axis a quarter of a wavelength long extending from a feed point for the first antenna and is electrically symmetrical about the axis;

wherein in use the quarter wave monopole is operable to receive and transmit signals omnidirectionally in azimuth and wherein the second antenna is operable to provide receive diversity.

2. A wireless subscriber terminal according to claim 1 wherein quarter wavelength monopole antenna has an elevated feed point.

3. A wireless subscriber terminal according to claim 1, wherein the first antenna is positioned in a vertical plane passing through the axis.

4. A wireless subscriber terminal according to claim 1, wherein the second antenna has a feed point not less than 0.18 wavelengths removed from the feed point of the first antenna.

5. A wireless subscriber terminal according to claim 1, wherein the feed point of the second antenna is mounted on a side surface associated with the ground plane.

6. A wireless subscriber terminal according to claim 1, wherein the terminal is operable for use upon a horizontal surface and the ground plane is angled with respect to the horizontal.

7. A wireless subscriber terminal according to claim 1, wherein the terminal is operable for use upon a horizontal surface and the ground plane is angled with respect to the horizontal and wherein the axis of the ground plane is oriented at an angle in the range of 20–90° to the horizontal.

8. A wireless subscriber terminal according to claim 1, wherein the terminal is operable for use upon a horizontal surface and the ground plane is angled with respect to the horizontal and wherein the first antenna is oriented at an angle between ±40° to the vertical.

9. A wireless subscriber terminal according to claim 1, wherein the terminal is operable for use upon a vertical surface and wherein the surface of the ground plane and the first antenna are arranged vertically.

10. A wireless subscriber terminal comprising:

a quarter wavelength monopole first antenna;

a folded monopole second antenna; and a ground plane having a surface angled with respect to the horizontal, wherein the ground plane has an axis a quarter of a wavelength long extending from a feed point for the first antenna and is electrically symmetrical about the and wherein the second antenna is an internally bent folded monopole.

11. A wireless subscriber terminal according to claim 10, wherein the second antenna has a feed point not less than 0.18 wavelengths removed from the feed point of the first antenna.

12. A wireless subscriber terminal according to claim 10, wherein the feed point of the second antenna is mounted on a side surface associated with the ground plane.

13. A method of operating a wireless subscriber terminal comprising:

a quarter wavelength monopole first antenna;

a folded monopole second antenna; and a ground plane having a surface angled with respect to the horizontal, wherein the ground plane has an axis a quarter of a wavelength long extending from a feed point for the first antenna and is electrically symmetrical about the axis wherein, in a receive mode, the method includes the steps of receiving signals through both antennas, wherein mutual coupling effects between the first antenna and the second antenna and between the first antenna and the casing are reduced.

14. A wireless subscriber terminal comprising:

a quarter wavelength monopole first antenna;

a folded monopole second antenna; and a ground plane having a surface angled with respect to the horizontal, wherein the ground plane has an axis a quarter of a wavelength long extending from a feed point for the first antenna and is electrically symmetrical about the axis;

wherein the feed point of the second antenna is mounted on a side surface associated with the ground plane.

15. A wireless subscriber terminal comprising:

a quarter wavelength monopole first antenna;

a folded monopole second antenna; and a ground plane having a surface angled with respect to the horizontal, wherein the ground plane has an axis a quarter of a wavelength long extending from a feed point for the first antenna and is electrically symmetrical about the and wherein the second antenna is an internally bent folded monopole;

wherein the second antenna has a feed point not less than 0.18 wavelengths removed from the feed point of the first antenna;

wherein the feed point of the second antenna is mounted on a side surface associated with the ground plane.

* * * * *